US006718566B1

(12) United States Patent
Wilson

(10) Patent No.: US 6,718,566 B1
(45) Date of Patent: Apr. 13, 2004

(54) VERTICALLY ADJUSTABLE SPA COVER ASSEMBLY

(76) Inventor: Jerry A. Wilson, 8780 Bunkerhill Rd., Port Washington, OH (US) 43837

( * ) Notice: Subject to any disclaimer, the term of this patent is extended or adjusted under 35 U.S.C. 154(b) by 0 days.

(21) Appl. No.: 10/253,299

(22) Filed: Sep. 24, 2002

(51) Int. Cl.[7] ..... E04H 4/00
(52) U.S. Cl. ..... 4/498; 4/503; 4/534; 4/580
(58) Field of Search ..... 4/498, 503, 534, 4/580; 52/3, 67

(56) References Cited

U.S. PATENT DOCUMENTS

| | | | | | |
|---|---|---|---|---|---|
| 2,825,352 | A | * | 3/1958 | Lemen | 135/155 |
| 3,566,420 | A | * | 3/1971 | Peterson et al. | 4/494 |
| 4,135,259 | A | * | 1/1979 | Scardenzan | 4/498 |
| 4,246,663 | A | | 1/1981 | Aragona et al. | |
| 4,426,744 | A | * | 1/1984 | Love | 4/503 |
| 4,500,071 | A | * | 2/1985 | Bagwell et al. | 254/423 |
| 5,035,094 | A | * | 7/1991 | Legare | 52/118 |
| 5,148,646 | A | | 9/1992 | Lutostanski | |
| 5,168,675 | A | | 12/1992 | Shea, Sr. | |
| D336,960 | S | | 6/1993 | Bedell | |
| 5,680,893 | A | | 10/1997 | Neer | |
| 5,745,932 | A | | 5/1998 | Barovetto | |
| 5,943,709 | A | | 8/1999 | Chiu | |
| 6,062,243 | A | | 5/2000 | Tuch et al. | |
| 6,079,059 | A | | 6/2000 | Girerd | |
| 6,102,059 | A | * | 8/2000 | Miller | 135/87 |
| 6,212,702 | B1 | | 4/2001 | Sitzmann | |
| 6,374,433 | B1 | | 4/2002 | Gray | |

* cited by examiner

*Primary Examiner*—Henry Bennett
*Assistant Examiner*—Azy Kokabi
(74) *Attorney, Agent, or Firm*—Sand & Sebolt

(57) ABSTRACT

A vertically adjustable spa cover assembly includes a cover movable above a spa between a raised position and a lowered position, the raised position being vertically above the lowered position. Lifts are used to raise and lower the cover. The cover assembly may also include a screen that surrounds the area between the cover and the spa. The lifts are threaded sections including rods and pipes which engage one another and move up and down as one or more of these threaded sections are rotated by a power source such as a motor or hand crank. The power source may engage the threaded sections through gears or sprockets, or less directly via a system of sprockets and a chain which drives the sprockets and the threaded sections in turn. Alternately, the lifts may be telescoping members pneumatically or hydraulically powered. The cover assembly may be built into a spa unit or added as a retrofit component.

20 Claims, 13 Drawing Sheets

VERTICALLY ADJUSTABLE SPA COVER ASSEMBLY

BACKGROUND OF THE INVENTION

1. Technical Field

The invention relates generally to spa cover assemblies. More particularly, the invention relates to moveable spa cover assemblies. Specifically, the invention relates to a vertically adjustable spa cover assemblies.

2. Background Information

Cover assemblies for spas, also known as hot tubs, and for swimming pools have been known for quite some time. There are a variety of configurations, some of which move in various ways. However, there is a need for a spa cover assembly which is vertically adjustable and which can be either built into a spa or added as a retrofit cover assembly. Such movable cover assemblies allow the user to selectively use the, cover assembly based on weather conditions.

The prior art includes a dome-shaped cover having a semi-dome-shaped portion that rotates about a central point above the spa to open and close the cover (U.S. Pat. No. 4,246,663 granted to Aragona et al.). U.S. Pat. No. 5,148,646 granted to Lutostanski discloses a convertible enclosure for hot tubs and the like, which includes a tubular frame with sliding cross pieces to which a cover is attached to encompass one side and the top of the space over the hot tub with one side remaining open. U.S. Pat. No. 5,680,893 granted to Neer discloses a retractable decorative screen to provide privacy around swimming pools and the like which slides back and forth horizontally on an overhead track, or on a cable or rope. U.S. Pat. No. 6,079,059 granted to Girerd discloses a movable covering device or roof which moves on hinged structural members from a position above a swimming pool to a position above an adjacent terrace. U.S. Pat. No. 6,212,702 granted to Sitzmann discloses a rectangular spa cover wherein two poles are hingedly connected to adjacent corners of the cover and hingedly connected to the spa deck to facilitate lifting the cover from a position on the ground beside the spa to a position over the spa, with two other poles then being respectively connected to the other two corners of the cover and the deck. U.S. Pat. No. 6,374,433 granted to Gray discloses a rigid house-like hot tub cover which moves horizontally along a deck on rollers or the like from a position over the hot tub to a position adjacent the hot tub.

BRIEF SUMMARY OF THE INVENTION

The invention provides one embodiment wherein a vertically adjustable spa cover assembly has lifts that move a cover, a screen or a combination thereof between a raised position and a lowered position.

In one embodiment, corner lifts are used to raise and lower the insulated cover of the spa. A screen may be connected to the cover.

BRIEF DESCRIPTION OF THE DRAWINGS

FIG. 16 is a perspective view of a fourth embodiment of the present invention in the raised position;

Similar numerals refer to similar parts throughout the drawings.

DETAILED DESCRIPTION OF THE INVENTION

Figure 1:
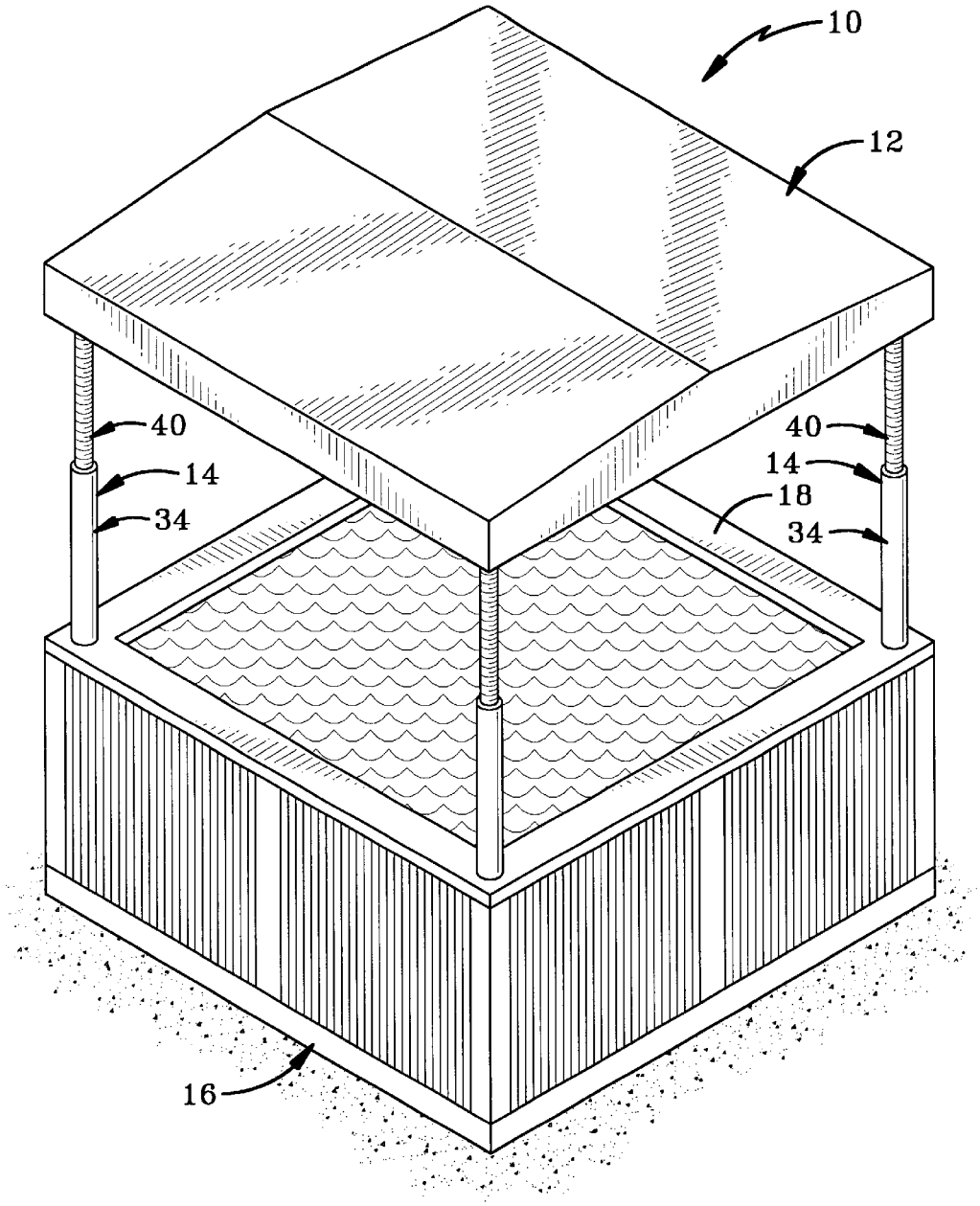
FIG. 1 is a perspective view of a first embodiment of the spa cover assembly of the present invention in the raised position.

The first embodiment of the spa cover assembly of the present invention is indicated generally at 10 in FIGS. 1–3 and 5–12. Cover assembly 10 includes cover 12 and lifts 14. Lifts 14 are configured to move cover 12 vertically between a raised position (FIG. 1) and a lowered position (FIG. 2) above a spa 16 having an upper surface 18.

Cover 12 sits atop four lifts 14 and may be attached thereto, if desired, by any suitable means. For example, cover 12 may be attached to lifts 14 with bolts, pins, screws, snap fits, etc. Preferably, any attachment used is removable both for safety and convenience. Cover 12 may also be attached to, for example, two lifts 14 by hinges (not shown) as a safety feature. Cover 12 may include thermal insulation (not shown) and may be made of a wide variety of materials, such as netting, or materials which are wind-proof, waterproof, transparent, translucent, opaque, and so forth. When cover 12 includes insulation, cover 12 is used to keep the water in spa 16 warm when spa 16 is not in use.

Lifts 14 may be made of a plastic material with appropriate strength which can withstand a wide range of temperature changes suitable to various weather conditions. They may be manufactured of nylon or reinforced nylon. Other materials that may be injection molded may be used. Various polymers and thermoplastics, or other suitable materials may also be used.

Figure 9:
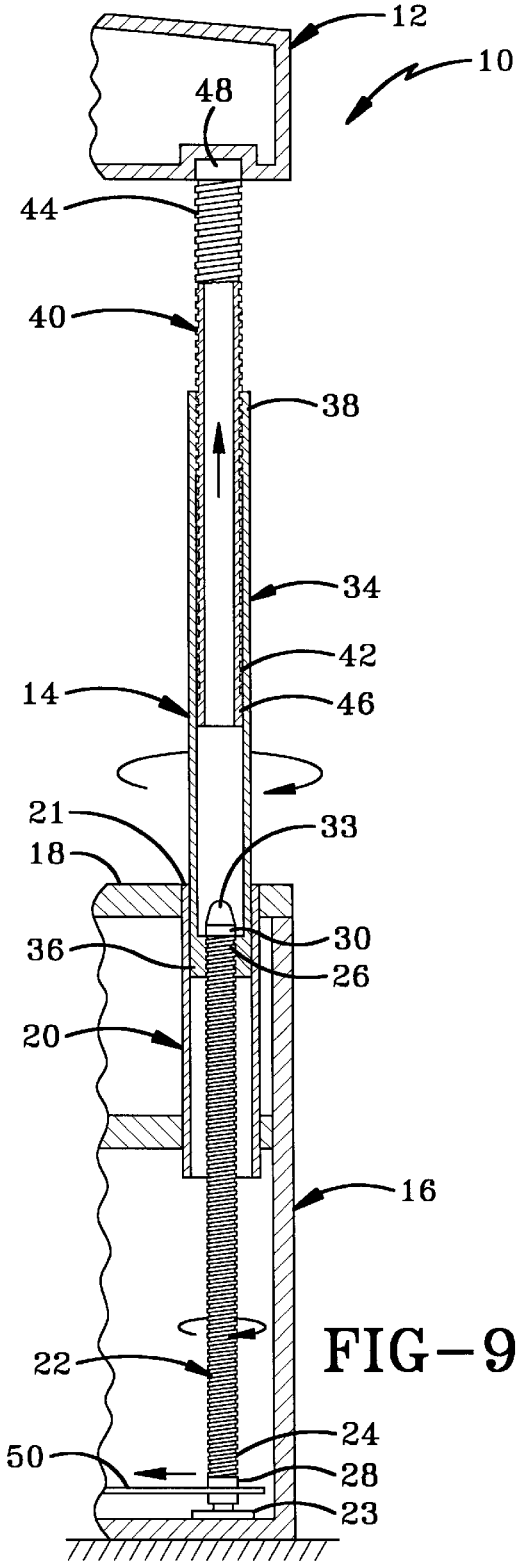
FIG. 9 is a fragmentary sectional view of the spa cover assembly in a further stage of being raised.
Figure 10:
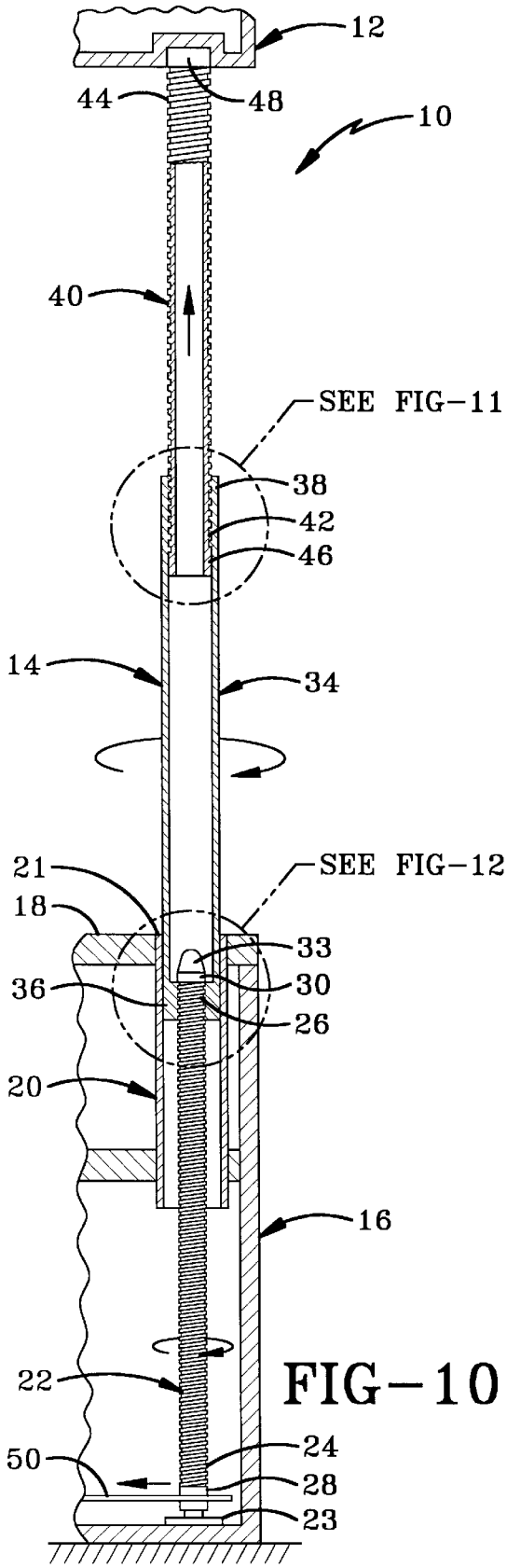
FIG. 10 is a fragmentary sectional view of the spa cover assembly in the raised position.
Figure 11:
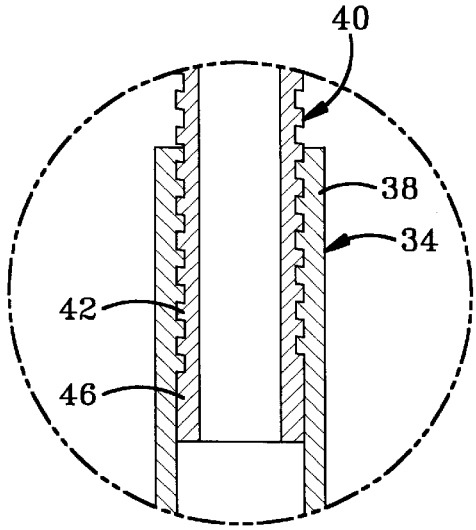
FIG. 11 is an enlarged view of the upper encircled portion of FIG. 10.
Figure 12:
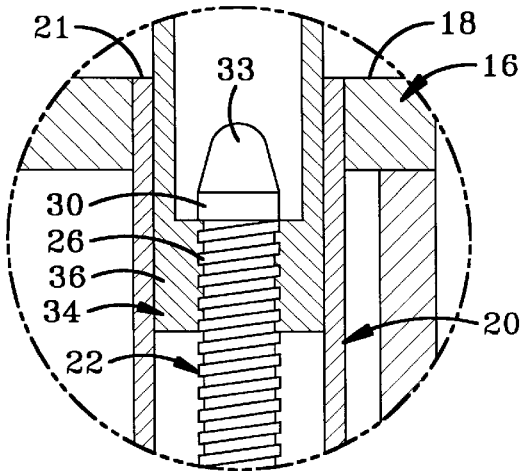
FIG. 12 is an enlarged view of the lower encircled portion of FIG. 10.

Each lift 14 (FIGS. 5–12) is housed at least partially in a sleeve 20 having a top 21 as each lift 14 moves between the lowered position (FIG. 5) and the raised position (FIG. 10). In the lowered position, lifts 14 are flush with or below upper surface 18 of spa 16.

Each lift 14 (shown in FIG. 10) includes a plurality of threaded sections each of which threadedly engages one of the other threaded sections. All threads used in lifts 14 have the same pitch. Ball screws may also be used, wherein there is a ball-bearing-to-thread engagement instead of a thread-to-thread engagement between the various sections of each lift 14. Specifically, lift 14 includes a lower section which is a threaded rod 22 sitting atop support member 23 and having a lower end 24 and an upper end 26. A lower stop 28 is connected to lower end 24, an upper stop 30 is connected to upper end 26, and a sprocket 32 (FIG. 3) is connected to lower stop 28. A tapered tip 33 is connected to upper stop 30. Each threaded rod 22 extends upwardly at slightly varying heights, as explained below.

Lift 14 also includes a medial section which is a hollow pipe 34 having a lower end 36 and an upper end 38, each end being internally threaded. Lower end 36 threadedly engages threaded rod 22. Lift 14 further includes an upper section which is an externally threaded hollow tube 40 having a bottom end 42 and a top end 44. A bottom stop 46 is connected to bottom end 42 and a top stop 48 is connected to top end 44. Hollow tube 40 threadedly engages upper end 38 of hollow pipe 34. Cover 12 sits atop stop 48.

In the lowered position (FIG. 5), rod 22 is situated substantially within pipe 34, which is in turn situated substantially within tube 40, and all three sections are partially housed within sleeve 20. In the raised position (FIG. 10), rod 22 is situated as in the lowered position with tapered tip 33, with upper stop pipe 30 and a upper end 26 being within pipe 34. In the raised position, bottom stop 46 and bottom end 42 of tube 40 are within pipe 34.

In the first embodiment of the invention, sprockets 32 (FIG. 3) engage a chain 50, which extends around the four sprockets 32 and engages a sprocket 52 attached to an electric motor 54. Chain 50 further engages tensioners 56. Motor 54 is wired to control buttons 58, which in turn is wired to attach to a source of electricity (not shown). Instead of a chain 50, a cable (not shown) held in tension may be used to engage rods 22 via reinforced channels (not shown) therein or pulleys (not shown) thereabout or the like instead of sprockets 32. In addition, a plurality of individual motors (not shown) may be used to raise and lower each respective lift 14, directly or indirectly, each motor being timed together to work simultaneously.

Figure 2:
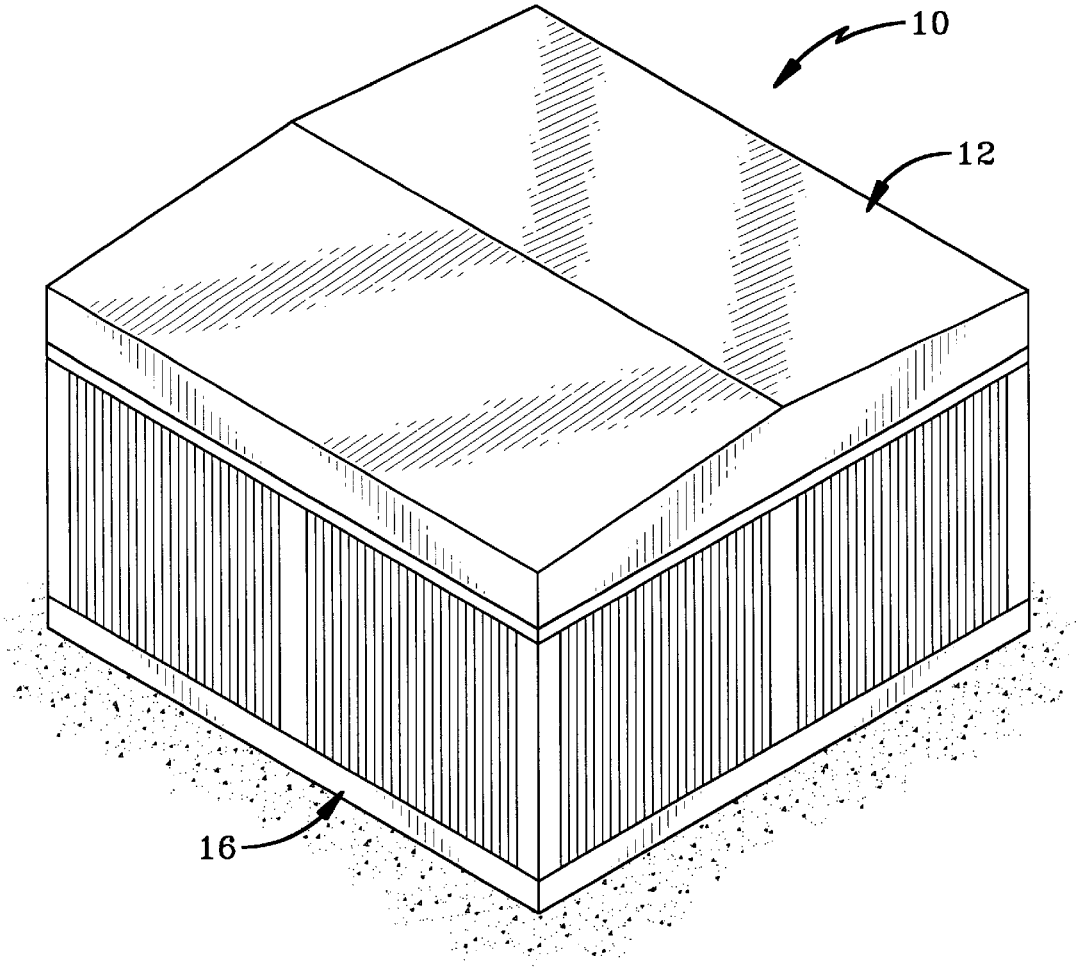
FIG. 2 is a perspective view of the first embodiment of the spa cover assembly in the lowered position.
Figure 3:
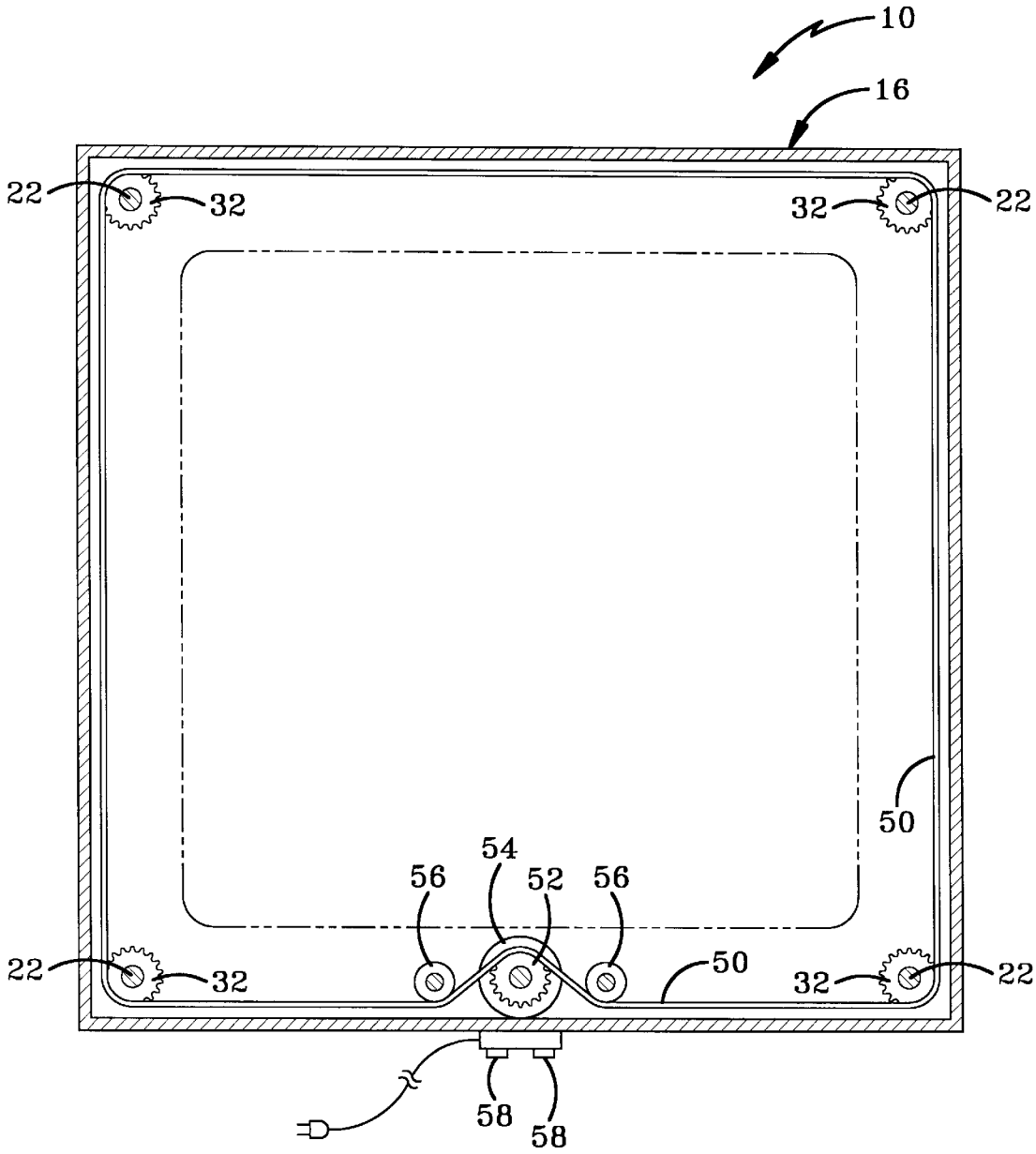
FIG. 3 is a schematic view of the first embodiment of the spa cover assembly showing the motor, sprockets and chain.
Figure 6:
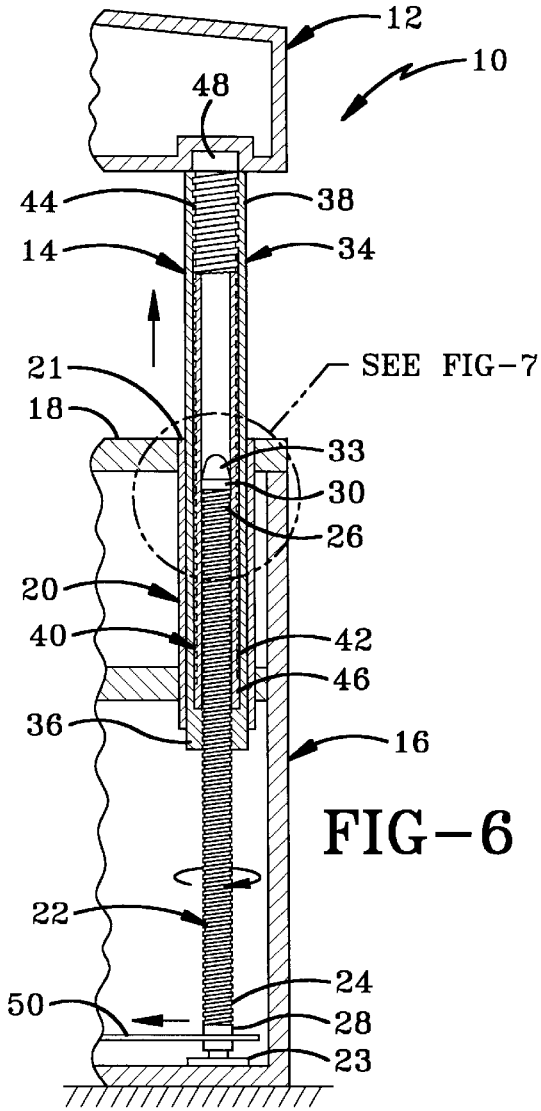
FIG. 6 is a fragmentary sectional view of the spa cover assembly in an intermediate position of being raised.
Figure 8:
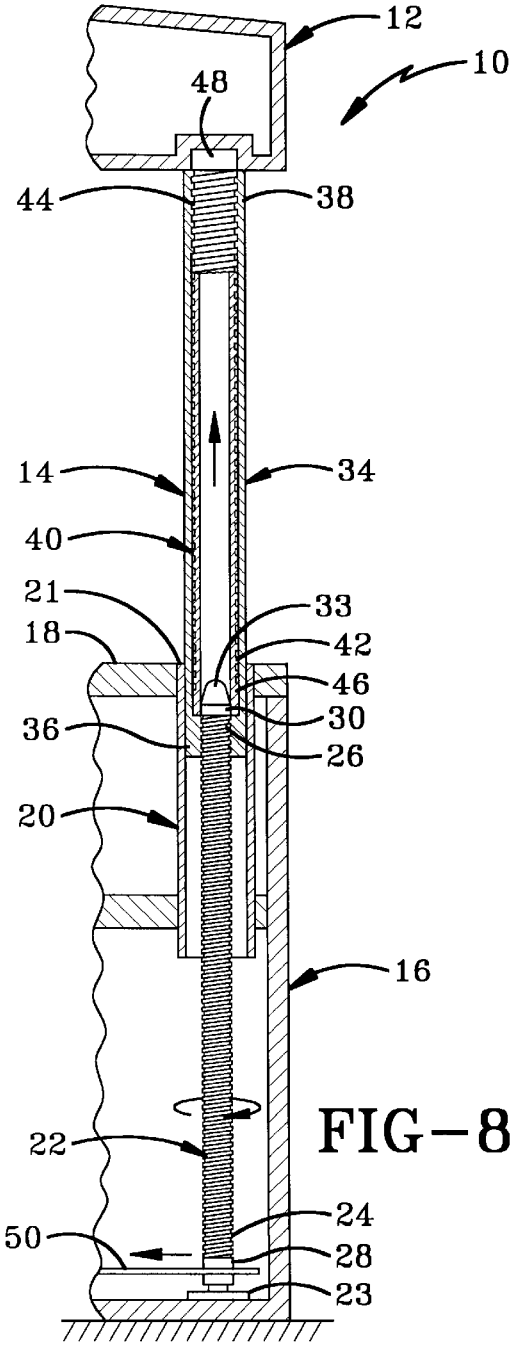
FIG. 8 is a fragmentary sectional view of the spa cover assembly in a further stage of being raised showing the medial section in a fully extended position.

Cover assembly 10 is configured to move between a raised position (FIG. 1) and a lowered position (FIG. 2). To raise assembly 10, a user pushes one of buttons 58 (FIG. 3) to supply electric power to operate motor 54 to rotate sprocket 52, which engages and drives chain 50, which in turn engages and rotates sprockets 32 and consequently threaded rod 22. Alternately, a cable (not shown) may be used to engage and rotate rod 22 as described above. The rotation of rod 22 causes it to unthread from threaded lower end 36 of hollow pipe 34, which causes pipe 34 and tube 40 to move vertically upward and begin raising assembly 10 (FIG. 6). Rod 22 unthreads from pipe 34 until upper stop 30 engages lower end 36 of pipe 34, thus preventing further unthreading and upward movement of pipe 34 (FIG. 8). Stop 30 also prevents the disengagement of pipe 34 from rod 22. As stop 30 engages lower end 36 of pipe 34, pipe 34 also begins to rotate along with rod 22. Because each rod 22 is a slightly different height, the engagement of each stop 30 with each respective lower end 36 is staggered a short time apart to ease torque on motor 54 that would occur if all rods 22 were the same height and all stops 30 thus engaged respective lower ends 36 simultaneously. The rotation of each pipe 34 along with rod 22 causes tube 40 to unthread from upper end 38 of pipe 34, which causes tube 40 to move vertically upward and continue the raising of assembly 10 (FIG. 9). Tube 40 unthreads from pipe 34 until bottom stop 46 engages upper end 38 of pipe 34, thus preventing further unthreading and upward movement of tube 40 (FIG. 10). Because all threads in lift 14 have the same pitch, assembly 10 is raised at a constant rate throughout the raising process. Lifts 14 may, however, include a tube 40 and an upper end 38 each having threads with a different pitch than those of rod 22 and lower end 36, so that the rate of raising would change when tube 40 began to unthread from upper end 38.

To lower cover assembly 10, the user pushes the other of buttons 58, which causes the motor to rotate in a direction opposite that for raising assembly 10. Thus, all moving parts move or rotate in opposite directions and the process is essentially reversed. As assembly 10 is lowered, tapered tip 33 serves a self-centering function to ensure that rod 22 will be smoothly inserted into tube 40. In lowering assembly 10, top stop 48 engages upper end 38 of pipe 34 to prevent further threading and downward movement of tube 40. Likewise, lower stop 28 of rod 22 engages lower end 36 of pipe 34 to prevent further threading and downward movement of rod 22.

As noted above, lifts 14 in the lowered position are flush with or below upper surface 18 of spa 16. Thus, cover 12 may be removed and lifts 14 lowered to eliminate unsafe protrusions extending upwardly from spa 16. Sleeve 16 may be covered or sealed against the entrance of water if desired.

Figure 4:
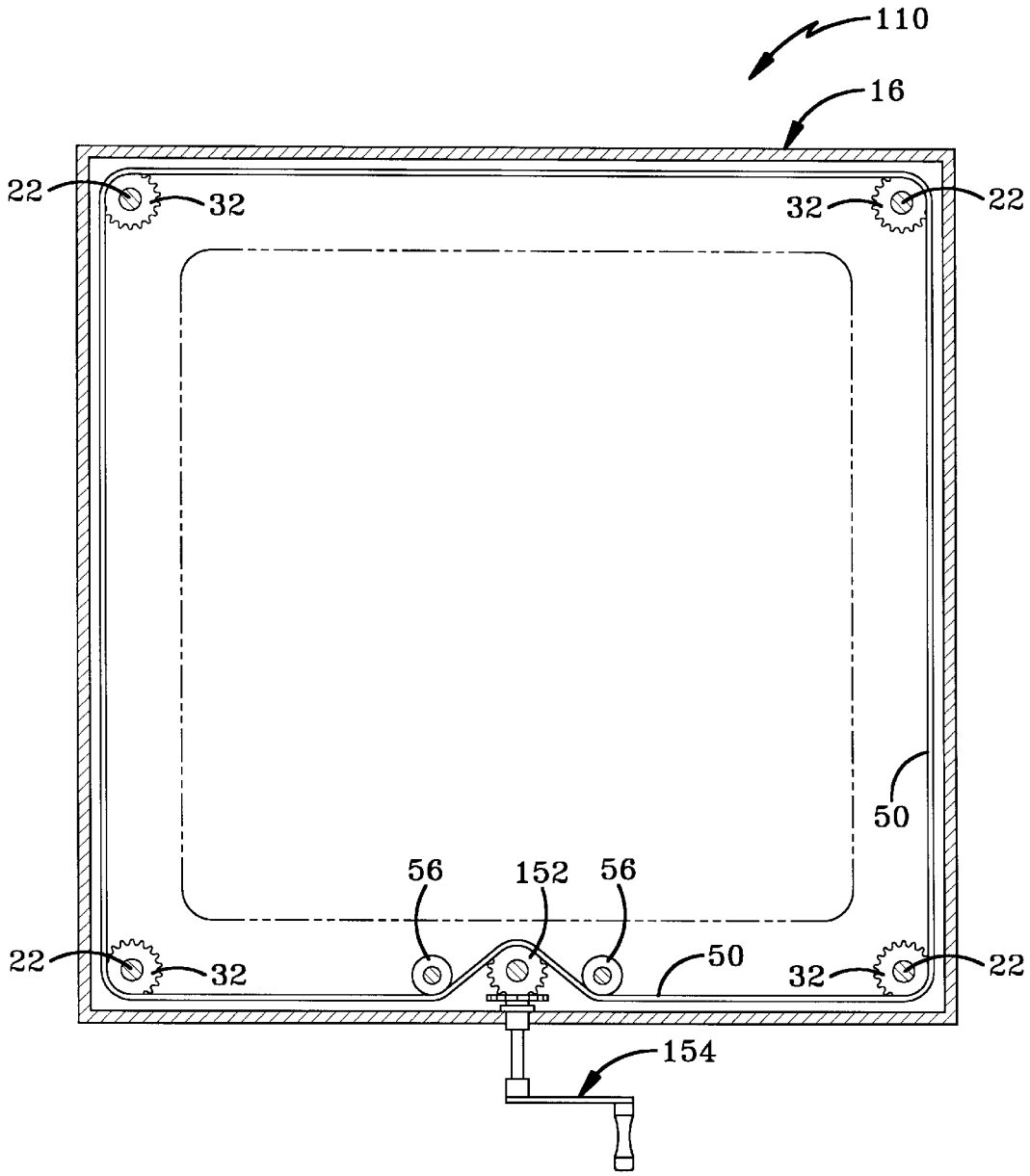
FIG. 4 is a schematic view of a second embodiment of the present invention.
Figure 7:
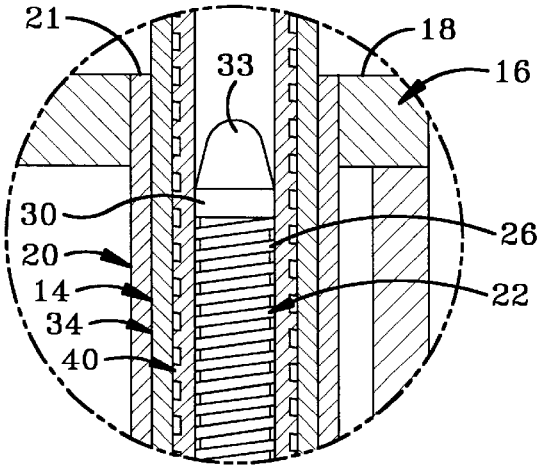
FIG. 7 is an enlarged view of the encircled portion of FIG. 6.
Figure 5:
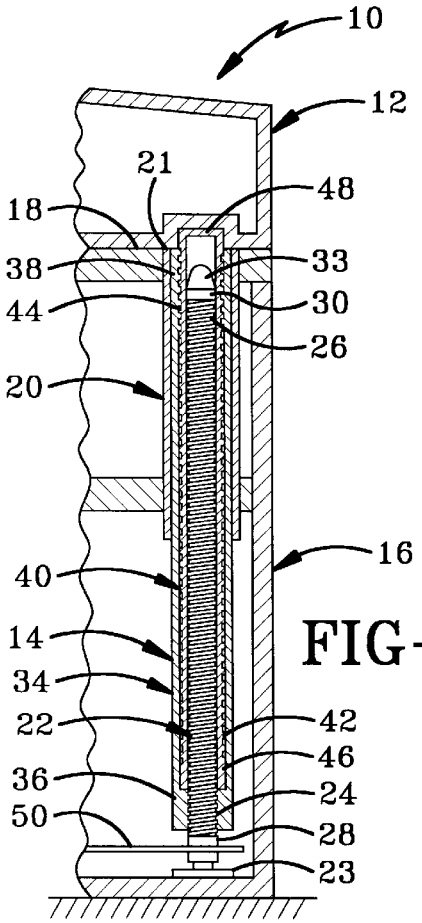
FIG. 5 is a fragmentary sectional view of the spa cover assembly in the lowered position showing one lift in its lowered position.

A second embodiment of the present invention is shown in FIG. 4 and includes modified cover assembly 110. Assembly 110 is similar to assembly 10 except that sprocket 152 engages a hand crank 154 (FIG. 4) as an alternate power source instead of motor 54 of assembly 10.

Figure 13:
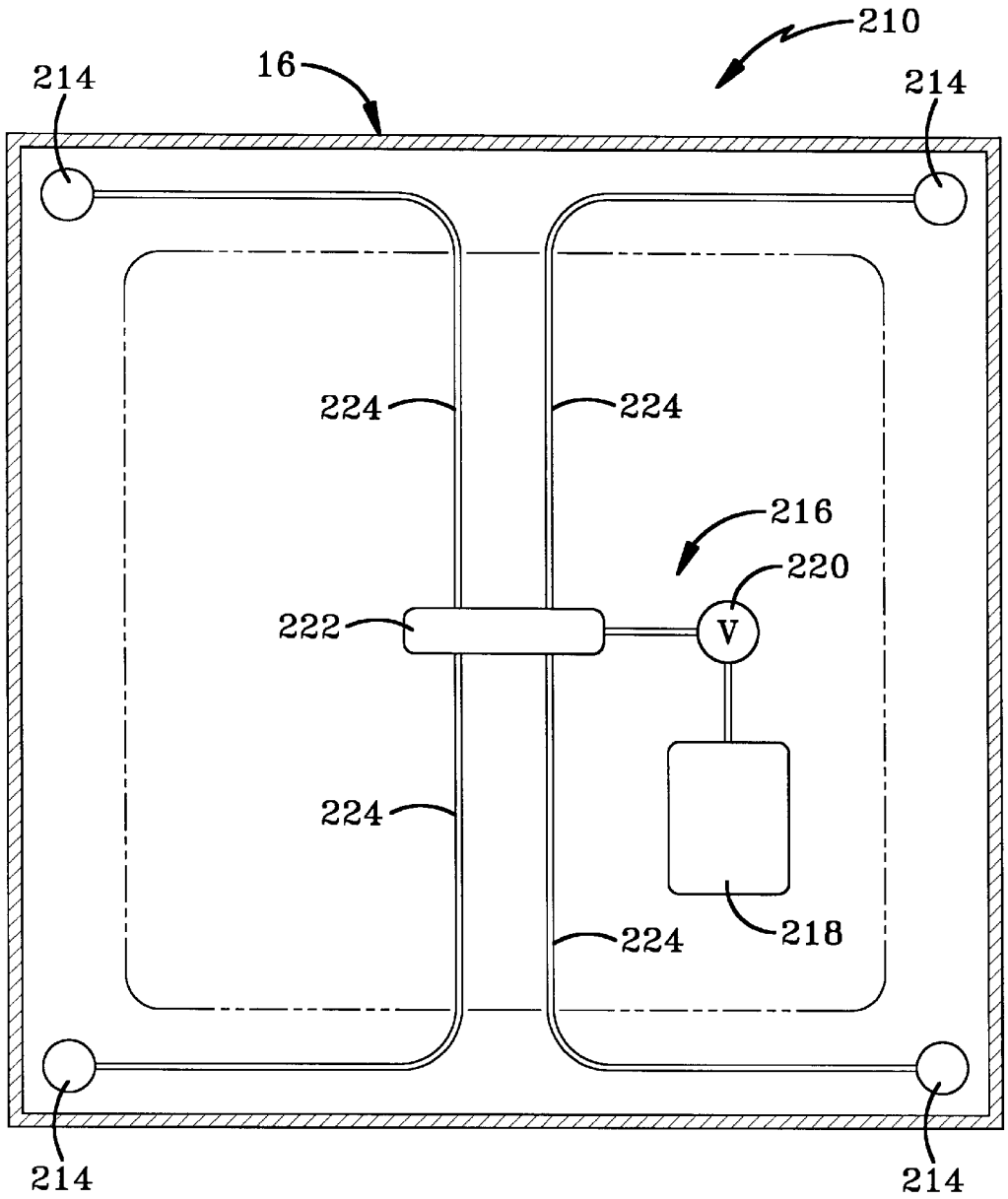
FIG. 13 is a schematic view of a third embodiment of the present invention.
Figure 14:
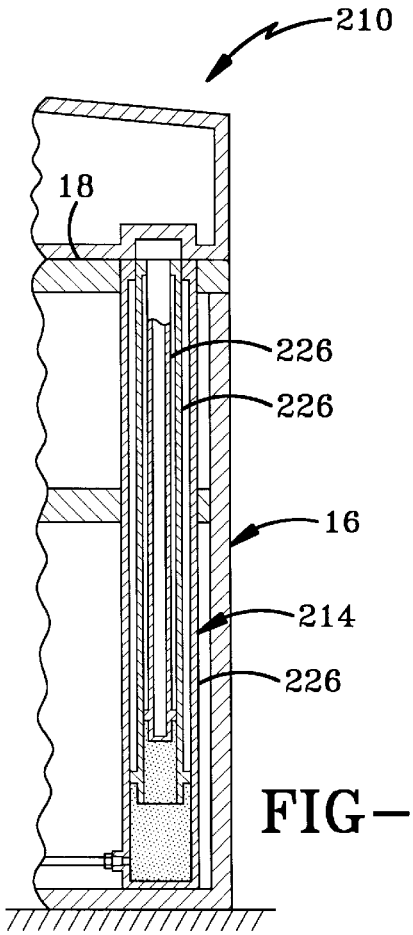
FIG. 14 is a fragmentary sectional view of the third embodiment of the present invention in the lowered position.
Figure 15:
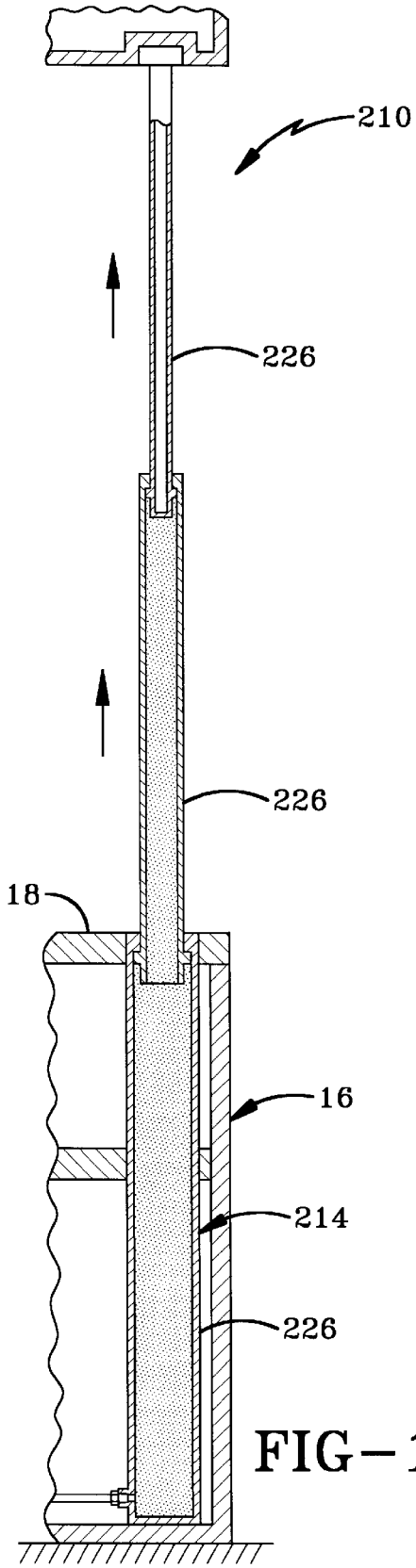
FIG. 15 is a fragmentary sectional view of the third embodiment of the present invention in the raised position.

A third embodiment of the present invention is shown in FIGS. 13–15 and includes modified cover assembly 210. Assembly 210 is similar to assembly 10 except that lifts 214 are different and that lifts 214 are operated by system 216, which is a pneumatic or hydraulic system. System 216 may include a source of power 218, a valve 220, a divider 222, and a plurality of lines 224, all respectively connected to one another. Lines 224 are connected to lifts 214. Source of power 218 is either pneumatic or hydraulic. Each lift 214 may include three telescoping members 226. Each lift 214 may also include a safety latch (not shown) to prevent assembly from falling in case system 216 fails. The safety latch may be, for example, a ratchet system attached to lift 214 or a solenoid valve located near lift 214.

Source of power 218 pressurizes air in the pneumatic system or hydraulic fluid in the hydraulic system. The source of power for the pneumatic system may be the compressor that is built in to many spas or a separate source. Valve 220 allows air or hydraulic fluid to flow in alternating directions to respectively raise and lower lifts 214. Divider 222 allows the air or fluid to branch so as to flow through lines 224 and vice versa. Lines 224 deliver the air or fluid to lifts 214 to raise and lower them. Telescoping members 226 are thus raised and lowered by a typical pneumatic or hydraulic system.

Figure 16A:
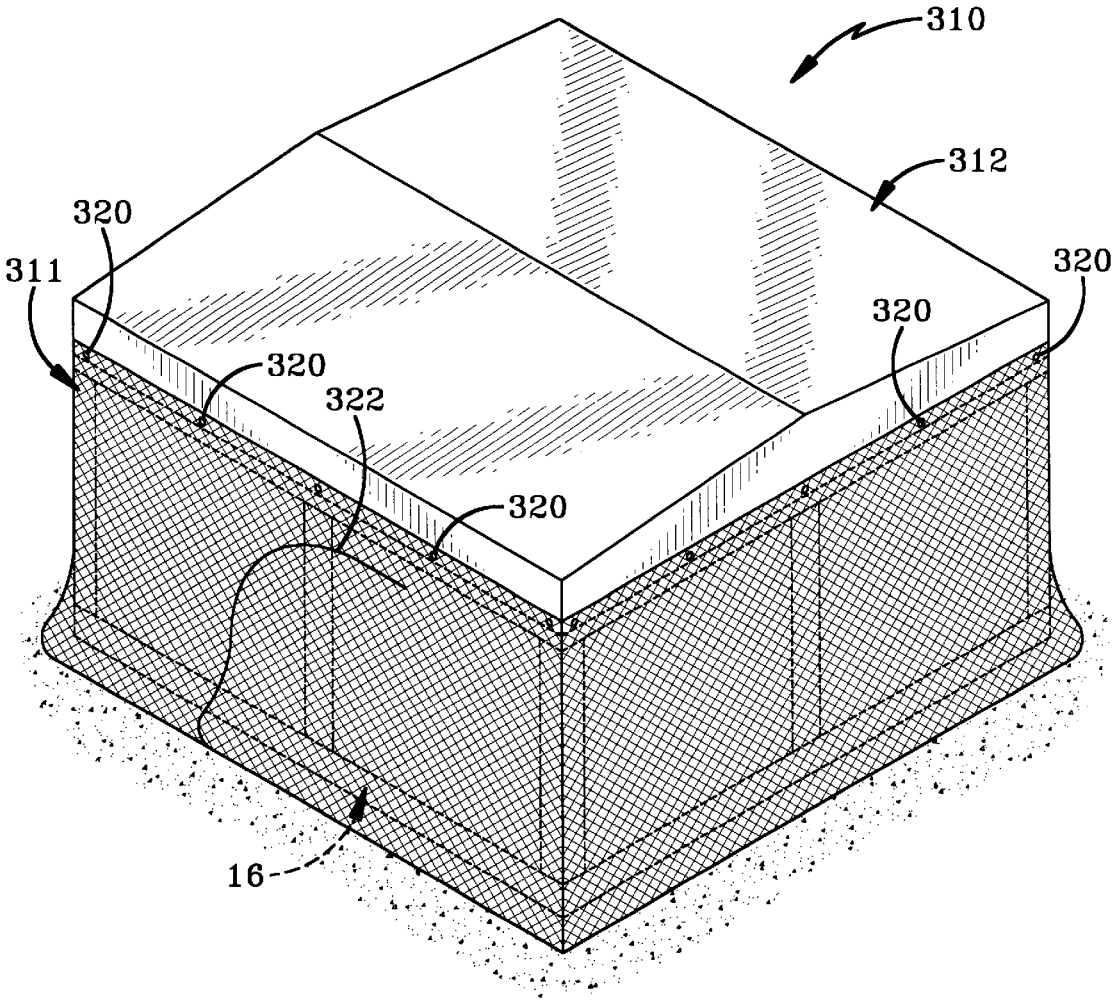
FIG. 16A is a perspective view of the fourth embodiment of the spa cover assembly in the lowered position.

A fourth embodiment of the present invention is shown in FIGS. 16 and 16A and includes modified cover assembly 310. Assembly 310 is similar to assembly 10 except that assembly 310 includes screen 311, which is removably attached to cover 312 by a plurality of snaps 320, velcro or other suitable fasteners, and may be attached to itself as well with fasteners. Screen 311 may also be attached to lifts 14 instead of cover 312, and thus screen 311 may be used without cover 12 if desired. Screen 311 includes a door 322, which may utilize a zipper or other suitable means for opening and closing. Screen 311 is a single piece of material surrounding the perimeter defined by lifts 14 in the raised position (FIG. 16) and surrounds spa 16 in the lowered position (FIG. 16A). Screen 311 may be provided in sections. Screen 311 may be netting, such as mosquito netting, or may be wind-proof, water-proof, insulated, transparent, translucent, opaque, or any variety of combinations thereof, or any other appropriate material.

Screen 311 adds the convenience of creating a wide variety of settings, to include netting to keep bugs out, or material to block wind and rain or provide shade in varying degrees. Amongst other things, it may also be used to add thermal insulation, privacy and for decorative purposes.

Figure 17:
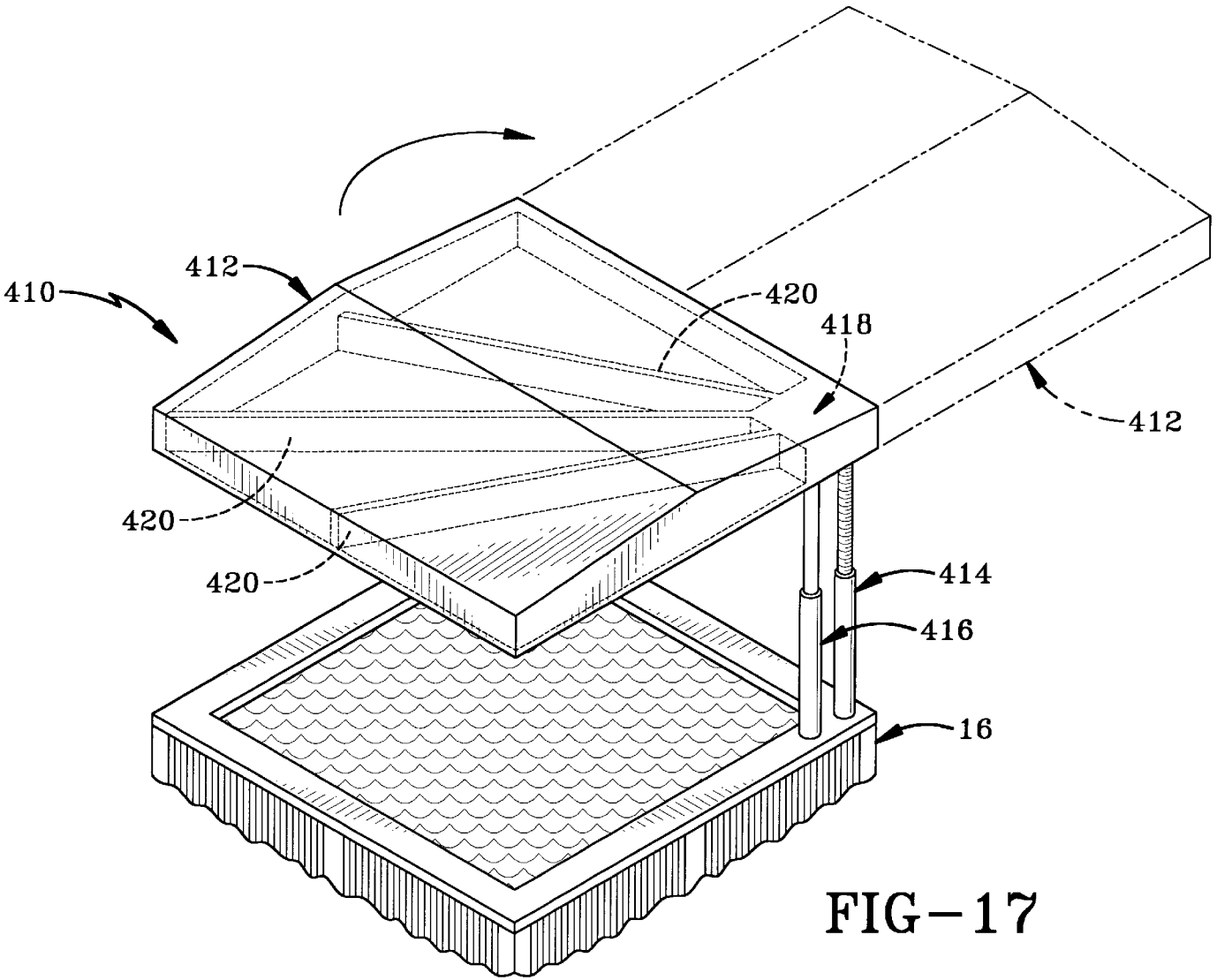
FIG. 17 is a fragmentary perspective view of a fifth embodiment of the present invention in the raised position showing a rotated position of the cover in phantom.

A fifth embodiment of the present invention is shown in FIG. 17 and includes modified cover assembly 410. Assembly 410 is similar to assembly 10 except that assembly 410 includes a modified cover 412, only one lift 414 and a telescoping guide 416. Guide 416 extends from cover 412 downward into spa 16 parallel to lift 414. Guide 416 is fixedly attached to spa 16 and is removably attached to cover 412. Cover 412 includes an attachment housing 418 attached to lift 414 and support arms 420 extending from housing 418. The power source (not shown) to rotate lift 414 may be as described above in relation to assemblies 10 and 110, with modifications as desired for a single lift 414, or as described below in relation to assembly 510. Cover 412 may also be hingedly attached to lift 414 as a safety precaution to allow the user to lift cover 412 in case of emergency, for example, where lift 414 became stuck in the lowered position due to loss of power to lift 414.

Cover assembly 410 is configured to allow cover 412 to rotate about lift 414 when in the raised position, allowing the user to alter shading on or adjacent the spa or alter the view from the spa without removing the cover. Guide 416 telescopes out and in to prevent said rotation while cover 412 is being raised or lowered, respectively. Guide 416 does not aid in lifting. When assembly 410 is in the raised position, guide 416 may detached from cover 412 to allow cover 412 to rotate as noted above. Housing 418 provides a structure for mounting cover 412 on lift 414, such as with a bracket (not shown). Arms 420 provide support for cover 412 to allow assembly 410 to function with only a single lift 414.

Figure 18:
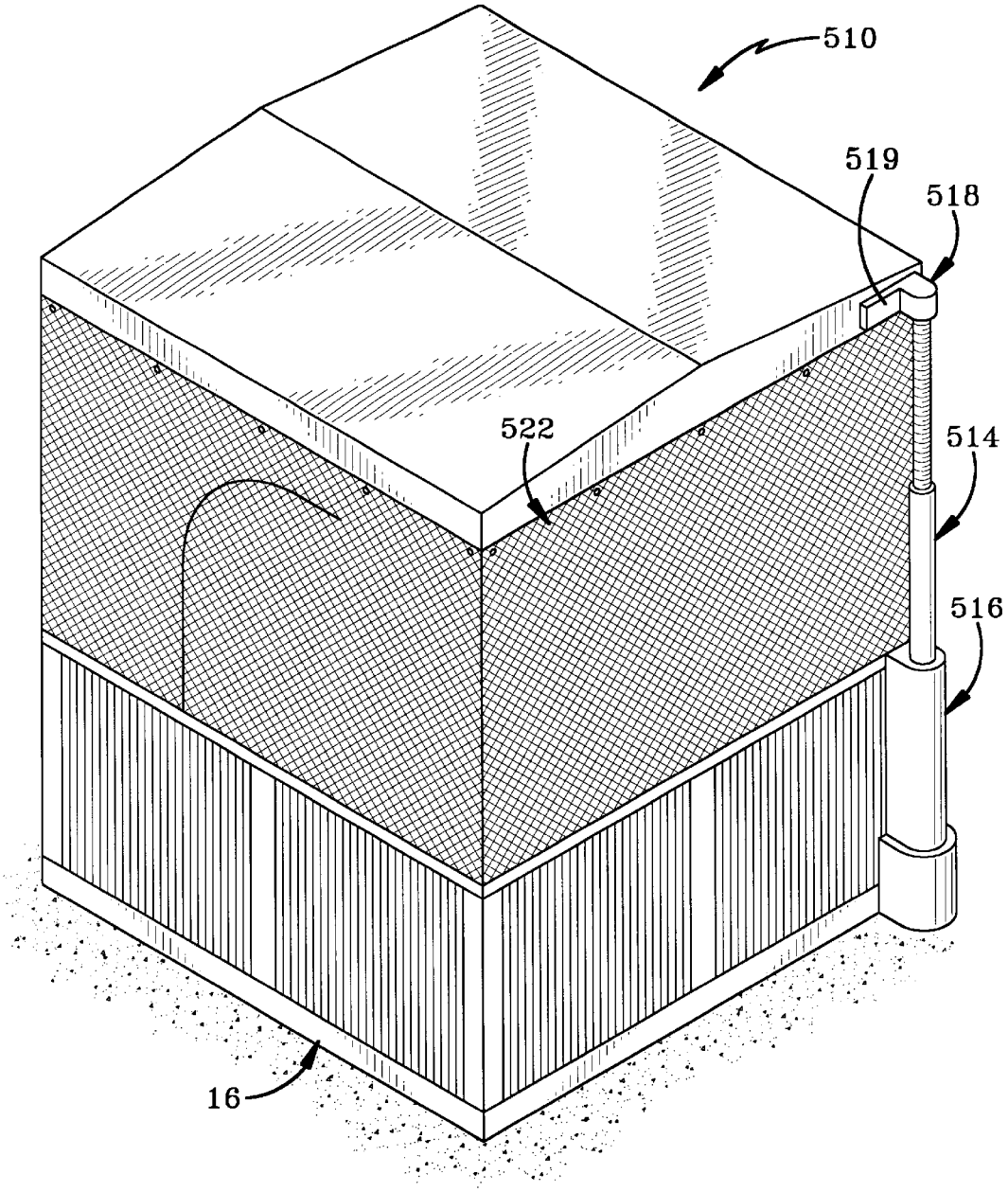
FIG. 18 is a perspective view of a sixth embodiment of the present invention in the raised position.
Figure 19:
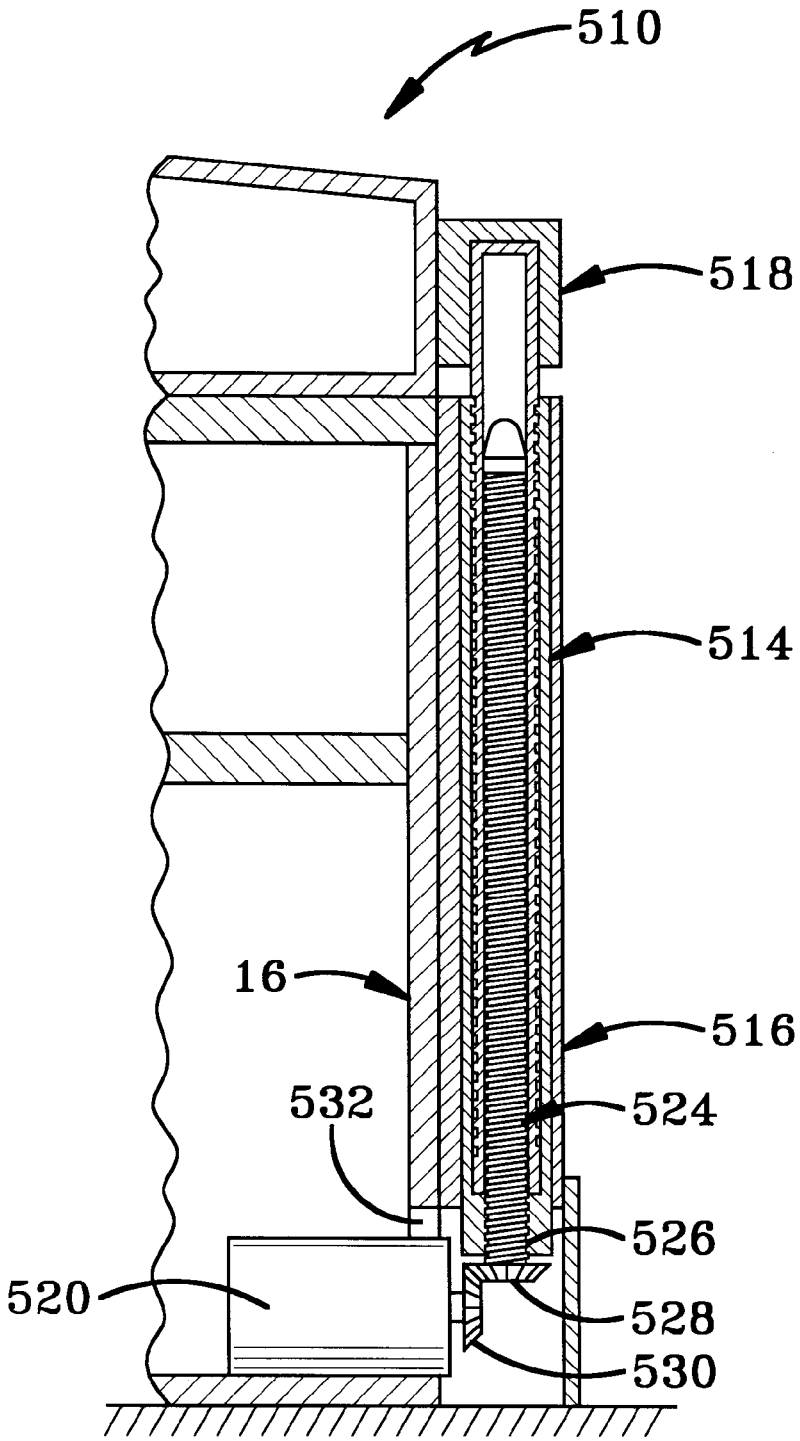
FIG. 19 is a fragmentary sectional view of the spa cover assembly shown in FIG. 18.

A sixth embodiment of the present invention is shown in FIGS. 18–19 and includes modified cover assembly 510. Assembly 510 is similar to assembly 410 (fifth embodiment) except that assembly 510 includes a modified lift 514, a lift housing 516, a modified attachment housing 518 connected to a bracket 519, a modified motor 520 and a screen 522, but does not include a guide (416), although a guide could be included. Lift 514 includes threaded rod 524 having a lower end 526 and a beveled gear 528 connected to rod 524 adjacent lower end 526. Motor 520 is connected to beveled gear 530 which engages gear 528. Spa 16 defines a hole 532 adjacent motor 520.

Assembly 510 is configured as a retrofit assembly which can be attached to spa 16. Motor 520 is inserted into hole 532 cut in spa 16 to protect motor 520 from weather. Lift housing 516 is attached to spa 16 to provide support for lift 514. Housing 516 also functions to guard motor 520 and lift 514 from weather and shields the user from moving parts. Housing 518 provides a structure for externally mounting cover 512 on lift 514 with bracket 519. Screen 522 surrounds spa 16 in the lowered position and as assembly 510 is being raised, and thus prevents the rotation of assembly 510 about lift 514 until screen 522 is above spa 16. While screen 522 prevents this rotation, a guide such as guide 416 (FIG. 17) may be included for this purpose, especially if the user wishes to use assembly 510 without screen 522. Motor 520 is adapted to bevel gear 530, which engages gear 528 to rotate lift 514 to raise and lower assembly 510. Other power sources may be used and the means of engaging and rotating rod 522 may vary.

In any of the embodiments involving lifts with threaded sections, the means of engaging the lower section of the lift could be a gear, a sprocket, a smooth or textured surface or other suitable configuration. One alternate example is a motor adapted with an elastomeric wheel which could engage and rotate the rod. Further, a variety of other means of lifting assembly 10 may be used. For example, assembly 10 may be lifted with levers in various arrangements, such as a scissors-type lift or a lift using levers and cables.

In the foregoing description, certain terms have been used for brevity, clearness and understanding, but no unnecessary limitations are to be implied therefrom beyond the requirement of the prior art, because such terms are used for descriptive purposes and are intended to be broadly construed. Moreover, the description and illustration of the invention is by way of example, and the scope of the invention is not limited to the exact details shown or described.

Having now described the features, discoveries and principles of the invention, the manner in which the vertically adjustable spa cover assembly is constructed and used, the characteristics of the construction, and the advantageous, new and useful results obtained; the new and useful structures, devices, elements, arrangements, parts and combinations are set forth in the appended claims.

What is claimed is:

1. A spa cover assembly for use with a spa having a body; the spa cover assembly comprising:

a cover having a raised position and a lowered position, the raised position being vertically above the lowered position;

at least one lift adapted to move the cover between the raised and lowered positions; the at least one lift including a plurality of threaded sections each of which is adapted to threadedly engage at least one of the other threaded sections; the at least one lift adapted to be mounted to the body of the spa; and a power source is adapted to rotate at least one of the sections to raise and lower the cover.

2. The assembly as defined in claim 1, wherein the cover includes thermal insulation.

3. The assembly as defined in claim 1, wherein the cover includes a screen.

4. The assembly as defined in claim 3 wherein the screen is removably attached to the cover.

5. The assembly as defined in claim 1 wherein the power source is adapted to engage a chain which in turn is adapted to rotate at least one section of the lift to raise and lower the cover.

6. The assembly as defined in claim 5 further comprising a plurality of lifts adapted to move the cover between the raised and lowered positions; the chain engaging each of the lifts.

7. The assembly as defined in claim 1 wherein the power source is one of a motor and a hand crank.

8. The assembly as defined in claim 1 wherein at least one of the sections includes an elongated member having external threads along substantially the entire length thereof.

9. The assembly as defined in claim 8 wherein one of the sections is a hollow member having opposed ends and having internally threaded portions adjacent each end.

10. The assembly as defined in claim 9 wherein the hollow member has an internally non-threaded portion between the threaded portions.

11. The assembly as defined in claim 1 wherein the plurality of sections includes first, second and third sections; the second section being disposed vertically intermediate the first and third sections when the cover is in the raised position; and wherein one of the sections includes a hollow tube within which one of the other sections nests when the cover is in the lowered position.

12. The assembly as defined in claim 11 wherein the first section is disposed below the second section and the first section includes the solid rod.

13. The assembly as defined in claim 1 wherein a plurality of lifts are used to raise and lower the cover; each of the lifts adapted to be mounted to the body of the spa.

14. A spa cover assembly comprising:

a screen having a raised position and a lowered position, the raised position being vertically above the lowered position;

at least one lift adapted to move the screen between the raised and lowered positions; the at least one lift including a plurality of threaded sections each of which is adapted to threadedly engage at least one of the other threaded sections;

the plurality of sections including a lower section, a medial section and an upper section;

the lower section including a threaded rod;

the medial section including a hollow pipe having an upper end and a lower end, the pipe adapted to include internally threaded portions adjacent both ends, and the lower end adapted to threadedly engage the threaded rod; and the upper section including an externally threaded hollow tube adapted to threadedly engage the upper end of the medial section.

15. The assembly as defined in claim 14 wherein the rod has ends and a stop is connected to each end; and the tube has ends and a stop is connected to each end.

16. The assembly as defined in claim 14 wherein a power source is adapted to rotate at least one of the sections.

17. The assembly as defined in claim 16 wherein the power source is adapted to engage a chain which in turn is adapted to rotate at least one of the sections to provide vertical movement of the screen.

18. The assembly as defined in claim 16 wherein the power source is one of a motor and a hand crank.

19. A spa cover assembly comprising:

a cover having a raised position and a lowered position, the raised position being vertically above the lowered position;

at least one lift adapted to move the cover between the raised and lowered positions; the at least one lift including a plurality of threaded sections each of which is adapted to threadedly engage at least one of the other threaded sections;

the plurality of sections including a lower section, a medial section and an upper section;

the lower section including a threaded rod;

the medial section including a hollow pipe having an upper end and a lower end, the pipe adapted to include internally threaded portions adjacent both ends, and the lower end adapted to threadedly engage the threaded rod; and the upper section including an externally threaded hollow tube adapted to threadedly engage the upper end of the medial section.

20. The assembly as defined in claim 19 wherein the rod has ends and a stop is connected to each end; and the tube has ends and a stop is connected to each end.

* * * * *